United States Patent [19]

Oppelt

[11] Patent Number: 4,992,769

[45] Date of Patent: Feb. 12, 1991

[54] LINE TRANSFORMER

[75] Inventor: Ralph Oppelt, Weiher, Fed. Rep. of Germany

[73] Assignee: Siemens Aktiengesellschaft, Berlin and Munich, Fed. Rep. of Germany

[21] Appl. No.: 442,541

[22] Filed: Nov. 28, 1989

[30] Foreign Application Priority Data

Nov. 28, 1988 [EP] European Pat. Off. ..... 88119827.9

[51] Int. Cl.[5] ..... H01F 27/28

[52] U.S. Cl. ..... 336/180; 333/25; 336/182; 336/200; 336/232

[58] Field of Search ..... 333/25, 26, 32, 33, 333/177; 336/200, 232, 180, 182, 183

[56] References Cited

U.S. PATENT DOCUMENTS

| | | | |
|---|---|---|---|
| 4,246,446 | 1/1981 | Yoshida et al. | 336/200 X |
| 4,430,758 | 2/1984 | Snyder | 333/26 X |
| 4,816,784 | 3/1989 | Rabjohn | 333/25 X |

FOREIGN PATENT DOCUMENTS

| | | |
|---|---|---|
| 60-258911 | 5/1986 | Japan . |
| WO/07074 | 11/1987 | PCT Int'l Appl. . |
| 1233894 | 6/1971 | United Kingdom . |

OTHER PUBLICATIONS

IBM Technical Disclosure Bulletin, vol. 8, No. 5, Oct., 1965, p. 723.

"Einige grundsatzliche Betrachtungen zu Breitband-Ubertragern" Hilberg, NTZ vol. 9, 1966, pp. 527-530.

"Modeling of Circular Spiral Inductors for NMICs," Wolff et al., IEEE MTT-S Int. Microwave Synp. Dig., vol. 1, pp. 123-126.

*Primary Examiner*—Thomas J. Kozma

*Attorney, Agent, or Firm*—Hill, Van Santen, Steadman & Simpson

[57] ABSTRACT

A line transformer suited for coupling the antenna of a nuclear magnetic resonance tomography apparatus to the RF transmission and reception circuitry is formed by a flat dielectric substrate having two congruent interconnect structures on the opposite major faces thereof. Each of the interconnect structures has two patterns of concentric conductor runs or strips, which are arranged mirror-symmetrically relative to a symmetry axis on both major faces of the substrate. The symmetry axes proceed parallel to each other, and are in registry with each other. A four port differential transformer without ferromagnetic material is obtained, which behaves symmetrically relative to the third and fourth ports, as seen from the first port as well as from the second port.

4 Claims, 2 Drawing Sheets

LINE TRANSFORMER

BACKGROUND OF THE INVENTION

1. Field of the Invention

The present invention is directed to a line transformer suitable for matching impedances in RF systems, such as in a nuclear magnetic resonance tomography apparatus.

2. Description of the Prior Art

Transformers suitable for operation with low frequency alternating currents generally contain a core of ferromagnetic material, with primary and secondary windings each consisting of a number of turns. The four pole formed in this manner is intended to modify current and voltage in a specified manner. Such transformers are suitable for impedance transformation as long as the length of the conductor forming one of the windings is short in comparison to the wavelength. As is known, radio antennas must also transmit electromagnetic energy, i.e., arbitrary signals, in an undistorted fashion at extremely high frequencies. In broadband transformers, therefore, the two windings are so tightly coupled that they form lines having a defined characteristic impedance and a negligible radiation loss. Virtually any rational voltage ratio can be achieved with line transformers (NTZ 1966, No. 9, pages 524–538).

It is also known that inductances can be made in so-called "pancake" design, also referred to as printed coils. Such inductances are formed by a conductor in the shape of a spiral which is arranged on the surface a flat piece of electrically insulating material. The opposite flat side of the insulator can be provided with a large-area metallization (1987 IEEE MTT-S Int. Microwave Symp. Dig., Vol. 1, pages 123–126).

Four port differential transformers are required in radio-frequency technology for realizing various decoupling and branching circuits, for example, directional couplers. These four ports, frequently referred to as hybrid sets in low-frequency technology, must be fashioned as line transformers to achieve a large bandwidth in order to reduce the transmission losses.

SUMMARY OF THE INVENTION

It is an object of the present invention to simplify and improve known line transformers.

It is a further object of the present invention to provide a four port differential transformer wherein the third and fourth ports behave symmetrically as seen from the first port as well as from the second port.

The above objects are achieved in accordance with the principles of the present invention in a line transformer having a flat dielectric substrate having opposite major faces, with an interconnect structure disposed on each of the major faces. The interconnect structures are congruent and are formed by conductor runs or strips. Each interconnect structure consists of mirror-symmetric patterns arranged on opposite sides of a symmetry axis on each face, with the symmetry axes being parallel and in registry.

This structure achieves a line transformer in strip-line technology which is simple to manufacture and contains no ferromagnetic parts. The transformer can thus be used in strong magnetic fields, for example, in the field of superconducting magnets, such as are used to generate the fundamental field of a nuclear magnetic resonance tomography apparatus. Symmetrical electrical properties are obtained due to the mirror-symmetric arrangement of the two patterns forming each interconnect structure. The required characteristic impedance Z can be set with the thickness of the substrate, i.e., the spacing of the two interconnect structures from each other, and with the width of the strip lines. The degree of coupling between the two inductances can also be set.

DESCRIPTION OF THE PREFERRED EMBODIMENTS

Figure 1:
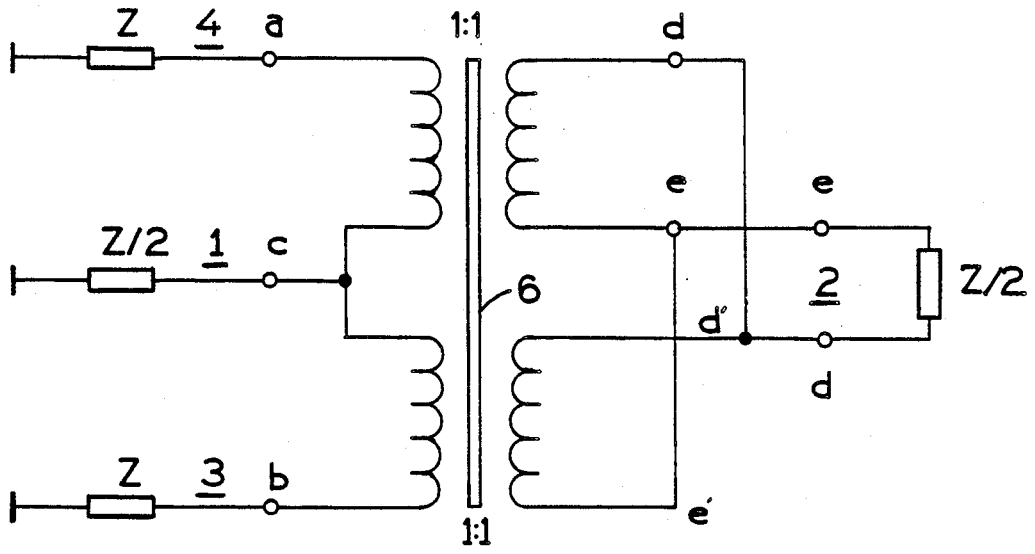
FIG. 1 is a schematic low frequency, equivalent circuit of a four port differential transformer, which applies to the line transformer constructed in accordance with the principles of the present invention.

In the low frequency equivalent circuit diagram of a four port differential transformer as shown in FIG. 1, having a voltage ratio of 1:1, the input terminal c and the ground terminal (not referenced in FIG. 1) allocated thereto form the port 1 (first port). The port 2 (second port) is formed by a terminal pair d and e. The port 3 (third port) is formed by the terminal b and the associated ground terminal (not shown), and the port 4 (fourth port) is formed by the terminal A and the allocated ground terminal. An optimum decoupling of the ports 3 and 4 and of the ports 1 and 2 is obtained with an impedance on the order of magnitude of the characteristic impedance Z of the ports 3 and 4, and with an impedance Z/2 at the ports 1 and 2. As is known, this four port differential transformer can be manufactured as a line transformer, wherein a preferably ferromagnetic carrier 6 is wound with lines having a predetermined impedance. For radio-frequency alternating fields, however, the use of ferromagnetic material causes additional transmission losses. Further, the operation of a transformer having parts consisting of ferromagnetic material cannot be undertaken in magnetic fields which must be maintained highly static, because the ferromagnetic parts disturb the otherwise static magnetic field.

It is also a problem to construct a four port differential transformer in strip line technology, corresponding to the circuit shown in FIG. 1, which behaves completely symmetrically relative to the ports 3 and 4 as seen from port 1 and as seen from port 2.

Figure 2:
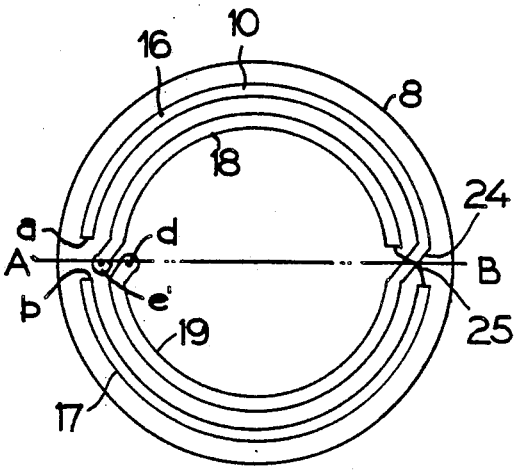
FIGS. 2 and 3 show an embodiment of the interconnect structures in a line transformer constructed in accordance with the principles of the present invention.
Figure 3:
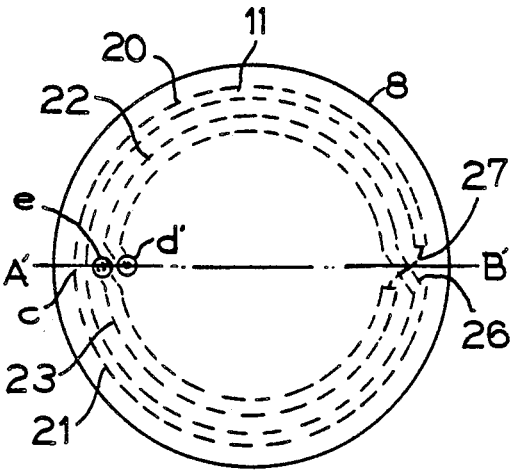

These problems are overcome in a line transformer constructed in accordance with the principles of the present invention, shown in a first embodiment in FIGS. 2 and 3. As shown in FIG. 2, a four port differential transformer embodying the circuit diagram of FIG. 1 is constructed in strip-line technology. The transformer contains a interconnect structure 10 consisting of sections 16, 17, 18 and 19 of electrically conductive material, preferably metal such as copper, on a first flat side (major face) of a substrate 8. The substrate 8 has a thickness of, for example, 0.8 mm and has a relative dielectric constant so that the substrate 8 serves as a dielectric between the interconnect structure 10 on one side shown in FIG. 2, and the interconnect structure 11 on the opposite side (opposite major face) of the substrate 8.

The sections 16–19 each consist of a portion of a ring, such as a half-ring. The substrate 8 may consist, for example, of plastic, tetrafluorethylene (Teflon ®), or of ceramic, for example, aluminum oxide ($Al_2O_3$). The two strip-line sections 16 and 17 are arranged mirror-symmetrically relative to a symmetry axis A, B. The two further strip-line sections 18 and 19, which are also arranged mirror-symmetrically relative to the symmetry axis A, B, are arranged concentrically with the strip-line sections 16 and 17. At the right, the two strip-line sections 16 and 19 are connected to each other by a bridge 24, which is preferably formed by a strip-line section having the same width as the strip-line sections 16 and 19. The two ends of the strip-line sections 17 and 18 are also connected to each other by a bridge 25 which is in the form of a wire bridge which is electrically insulated from the bridge 24. The respective ends a and b of the strip-line sections 16 and 17 and the respective ends d and e' of the strip-line sections 18 and 19 are arranged opposite one another on the surface of the substrate 8 at the left side.

As shown in FIG. 3, another interconnect structure 11 consisting of strip-line sections 20–23 is arranged on the opposite flat side (major face) of the substrate 8. The strip-line sections 20–23 are congruent (in registry) with the strip-line sections 16–19 of the opposite side. Two strip-lines 20 and 21 are arranged mirrorsymmetrically relative to a symmetry axis A', B', as are the other two strip-line sections 22 and 23. Since the interconnect structure 11 is not visible from the face on which the interconnect structure 10 is disposed, the interconnect structure is shown in dashed lines in FIG. 3.

The symmetry axes A B and A' B' are parallel to each other and in registry on the opposite sides of the substrate 8. On the right side as shown in FIG. 3, the ends of the strip-line sections 22 and 23 are connected by a bridge 26, and the ends of the strip-line sections 20 and 23 are connected by a bridge 27. The bridge 26 consists of a strip-line section, whereas the bridge 27 is a wire bridge which is electrically insulated from the bridge 26.

At the left side of FIG. 3, the other ends of the strip-lines 20 and 21 are connected to each other at the terminal c, and the terminals d' and e are arranged opposite one another. The terminal d of the interconnect structure 10 on the first flat side is connected by a line bridge to the terminal d' of the interconnect structure 11 on the second, opposite flat side of the substrate 8. The same is true for the terminals e' and e. These line connects can be produced in a simple manner by a bore in the substrate 8 with an electrically conductive filling, for example filled with solder, at the appropriate locations. The terminal designations indicated by lower case letters in FIGS. 2 and 3 are also shown in FIG. 1, correlated with the ports 1–4.

When a signal is supplied to the port 1 of the embodiment of FIGS. 2 and 3, this signal is symmetrically divided to the ports 3 and 4. In the same manner, a signal supplied to the port 2 is symmetrically divided to the ports 3 and 4. For the operation of a circularly polarizing antenna in a nuclear magnetic resonance tomography apparatus, for example, the receiver can be connected to the port 1, the transmitter can be connected to the port 2, and the two antenna ports can be connected to the ports 3 and 4 with a 90° two-phase network therebetween.

Figure 4:
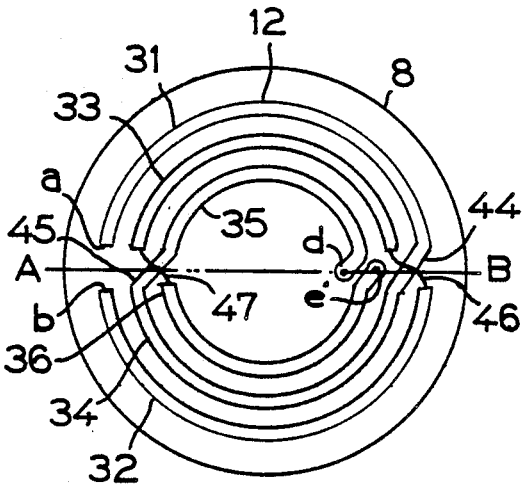
FIGS. 4 and 5 show a further embodiment of the interconnect structures in a line transformer constructed in accordance with the principles of the present invention.
Figure 5:
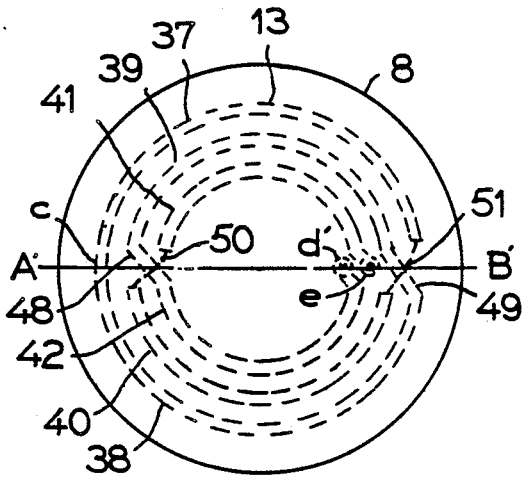

In the embodiment of FIGS. 4 and 5, interconnect structures 12 and 13 are respectively disposed on the opposite flat sides of the substrate 8. The interconnect structure 12 consists of strip-line sections 31–36, and the interconnect structure 13 consists of strip-line sections 37–42. The strip-line sections 31, 33, and 35 are arranged mirror symmetrically with respect to the strip-line sections 32, 34 and 36 again with a symmetry axis A, B. The strip-line sections 31–36, in combination, form concentric rings. As shown at the right side of FIG. 4, the strip-line sections 31 and 34 are connected by a bridge 44, and at the left side of FIG. 4, the ends of the strip-line sections 34 and 35 are connected by a bridge 45. At the right side of FIG. 4, the strip-line sections 33 and 32 are connected by a bridge 46, and at the left side of FIG. 4, the strip-line sections 36 and 33 are connected by a bridge 47. The bridges 44 and 45 are strip-lines, whereas the bridges 46 and 47 are wire bridges, respectively electrically insulated from the bridges 44 and 45.

The ends a and b of the strip-line sections 31 and 32 at the left side of FIG. 4 are disposed opposite each other with respect to the symmetry axis A, B. Similarly, the ends of the strip-line sections 35 and 36 are opposite each other at the right side of FIG. 4.

As shown in FIG. 5, the strip-line sections 37 and 38 on the opposite side of the substrate 8 are connected by a bridge c. The strip-line sections 39 and 42 are connected to each other by a bridge 48 at the left side of FIG. 5, and the strip-line sections 39 and 38 are connected by a bridge 49 at the left side of FIG. 5. The strip-line sections 38 and are electrically connected to each other at the right side of FIG. 5 by a bridge 49, and the strip-line sections 40 and 41 are connected to each other at the left side of FIG. 5 by a bridge 50. The bridges 48 and 49 are strip-lines, and the bridges 50 and 51 are wire bridges which are respectively electrically insulated from the bridges 48 and 49. As shown in FIG. 5, the ends d' and e of the strip-line sections 42 and 41 are respectively electrically connected to the ends d and e' of the strip-line sections 35 and 36 on the opposite side of the substrate 8. This line connection can again be produced by a through-contact located at these ends, since these ends of the strip-line sections will be situated in registry on the opposite faces due to the congruent arrangement of the strip-lines.

The embodiment of FIGS. 4 and 5 having an uneven number of rings has the advantage over the embodiment of FIGS. 2 and 3 having an even number of rings in that the terminal pair d and e (port 2 in FIG. 1) is at a larger spatial distance from the other ports.

The above embodiments have been described in the format of interconnect structures consisting of concentric semi-circles because the highest inductance with the shortest line length (thereby resulting in the lowest electrical losses) is obtained with rings. Other patterns may also be used, however, in the context of the present invention. For example, the strip-line sections may form ellipses or rectangles or any structure which can be arranged on a flat surface of the substrate 8 in mirror-symmetric fashion relative to a center symmetry axis.

Although other modifications and changes may be suggested by those skilled in the art, it is the intention of the inventor to embody within the patent warranted hereon all changes and modifications as reasonably and properly come within the scope of his contribution to the art.

I claim as my invention:

1. A line transformer comprising:

a dielectric substrate having two opposite flat major faces;

a strip-line interconnect structure disposed on each of said major faces, said interconnect structures being in registry on the respective major faces;

each interconnect structure consisting of two mirror-symmetric patterns arranged relative to a symmetry axis thereby forming a plurality of concentric strip-lines; and the respective symmetry axes on said major faces being parallel and in registry.

2. A line transformer as claimed in claim 1, wherein said patterns are half-rings.

3. A line transformer as claimed in claim 2, wherein said patterns form an uneven number of said strip-lines.

4. A line transformer as claimed in claim 1, further comprising a plurality of metallized bores in said substrate disposed at selected ends of said strip-lines for electrically connecting selected strip-lines on opposite sides of said substrate.

* * * * *